US006161287A

United States Patent [19]

Swanson et al.

[11] Patent Number: 6,161,287

[45] Date of Patent: Dec. 19, 2000

[54] RAZOR BLADE SYSTEM

[75] Inventors: Gerald Ted Swanson, Kingston; Paul Flaherty; Matthew Joseph Guay, both of Pembroke; Stephen C. Metcalf, North Attleboro, all of Mass.

[73] Assignee: The Gillette Company, Boston, Mass.

[21] Appl. No.: 09/066,499

[22] Filed: Apr. 24, 1998

[51] Int. Cl.[7] ..... B26B 21/02

[52] U.S. Cl. ..... 30/50; 30/47

[58] Field of Search ..... 30/50, 527, 530, 30/531, 41, 34.2

[56] References Cited

U.S. PATENT DOCUMENTS

| | | | |
|---|---|---|---|
| D. 373,218 | 8/1996 | Shurtleff et al. | D28/47 |
| D. 415,315 | 10/1999 | Swanson et al. | D28/47 |
| 1,744,280 | 1/1930 | Peterson | 30/41 |
| 1,768,307 | 6/1930 | Bleloch | 30/81 |
| 2,183,554 | 12/1939 | Evans | 30/84 |
| 3,477,127 | 11/1969 | Regan | 30/41 |
| 3,522,678 | 8/1970 | Scholin | 51/285 |
| 3,673,684 | 7/1972 | Muntz | 30/34.2 |
| 3,675,323 | 7/1972 | Braginetz | 30/32 |
| 3,702,026 | 11/1972 | Scholin | 30/49 |
| 3,880,284 | 4/1975 | Pomfret | 206/354 |
| 4,324,041 | 4/1982 | Trotta | 30/50 X |
| 4,328,615 | 5/1982 | Bowman et al. | 30/32 |
| 4,378,634 | 4/1983 | Jacobson | 30/47 |
| 4,389,773 | 6/1983 | Nissen et al. | 30/50 |
| 4,483,068 | 11/1984 | Clifford | 30/49 |
| 4,868,983 | 9/1989 | Francis | 30/50 |
| 4,875,288 | 10/1989 | Trotta et al. . | |
| 4,964,214 | 10/1990 | Welsh et al. | 30/49 |
| 4,970,784 | 11/1990 | Althaus et al. | 30/89 |
| 4,984,365 | 1/1991 | Leonard et al. | 30/34.05 |
| 5,031,317 | 7/1991 | Jacobson | 30/49 |
| 5,063,667 | 11/1991 | Jacobson | 30/41 |
| 5,063,669 | 11/1991 | Althaus | 30/77 |
| 5,084,968 | 2/1992 | Trotta | 30/47 |
| 5,088,195 | 2/1992 | Lazarshik et al. | 30/49 |
| 5,113,585 | 5/1992 | Rogers et al. | 30/41 |
| 5,153,992 | 10/1992 | Brown et al. | 30/49 |
| 5,191,712 | 3/1993 | Crook et al. | 30/34.2 |
| 5,222,300 | 6/1993 | Althaus et al. | 30/50 |
| 5,249,361 | 10/1993 | Apprille, Jr. et al. | 30/77 |
| 5,253,420 | 10/1993 | Althaus et al. | 30/50 |
| 5,347,716 | 9/1994 | Crook | 30/34.2 X |
| 5,454,164 | 10/1995 | Yin et al. | 30/41 |
| 5,526,567 | 6/1996 | Carson, III et al. | 30/50 |
| 5,533,263 | 7/1996 | Gilder | 30/87 |
| 5,535,518 | 7/1996 | Althaus | 30/89 |
| 5,551,153 | 9/1996 | Simms | 30/41 |
| 5,604,983 | 2/1997 | Simms et al. | 30/49 |
| 5,661,907 | 9/1997 | Apprille, Jr. | 30/47 |
| 5,761,814 | 6/1998 | Anderson et al. | 30/50 |
| 5,784,790 | 7/1998 | Carson, III et al. | 30/532 |
| 5,956,851 | 9/1999 | Apprille, Jr. et al. | 30/47 |

FOREIGN PATENT DOCUMENTS

| | | | |
|---|---|---|---|
| 4-361783 | 7/1991 | Japan | B26B 21/22 |
| 1 158 317 | 4/1981 | United Kingdom | B26B 21/54 |
| 2083398 | 3/1982 | United Kingdom | 30/82 |
| WO 89/01394 | 2/1989 | WIPO | B26B 21/22 |
| WO 96/02369 | 2/1996 | WIPO | B26B 21/14 |
| WO 97/17174 | 5/1997 | WIPO | B26B 21/00 |
| WO 97/37819 | 10/1997 | WIPO . | |
| WO 99/16591 | 4/1999 | WIPO | B26B 21/22 |

OTHER PUBLICATIONS

Complete International Search Report in corresponding PCT/US/99/08609, dated Dec. 21, 1999.

*Primary Examiner*—Douglas D. Watts
*Attorney, Agent, or Firm*—Edward S. Podszus

[57] ABSTRACT

A safety razor system includes an elongated housing pivotably attached to a member connecting the housing to a handle. The housing is substantially rectangular, having arcuate end portions. A plurality of razor blades and a guard member extend from the upper surface of the housing and an annular retainer clip is disposed about the periphery of the housing serving to retain the blades onto the housing and position the blades relative to the guard member. The connecting member pivotably supports the housing by four coaxial bearing surfaces contacting mating surfaces on the housing during rotation of the housing relative to the connecting member.

69 Claims, 10 Drawing Sheets

FIG. 6
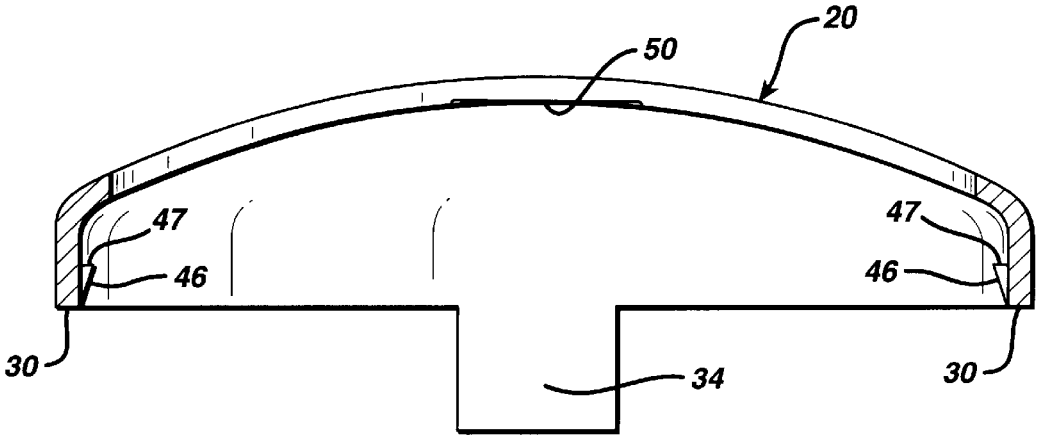
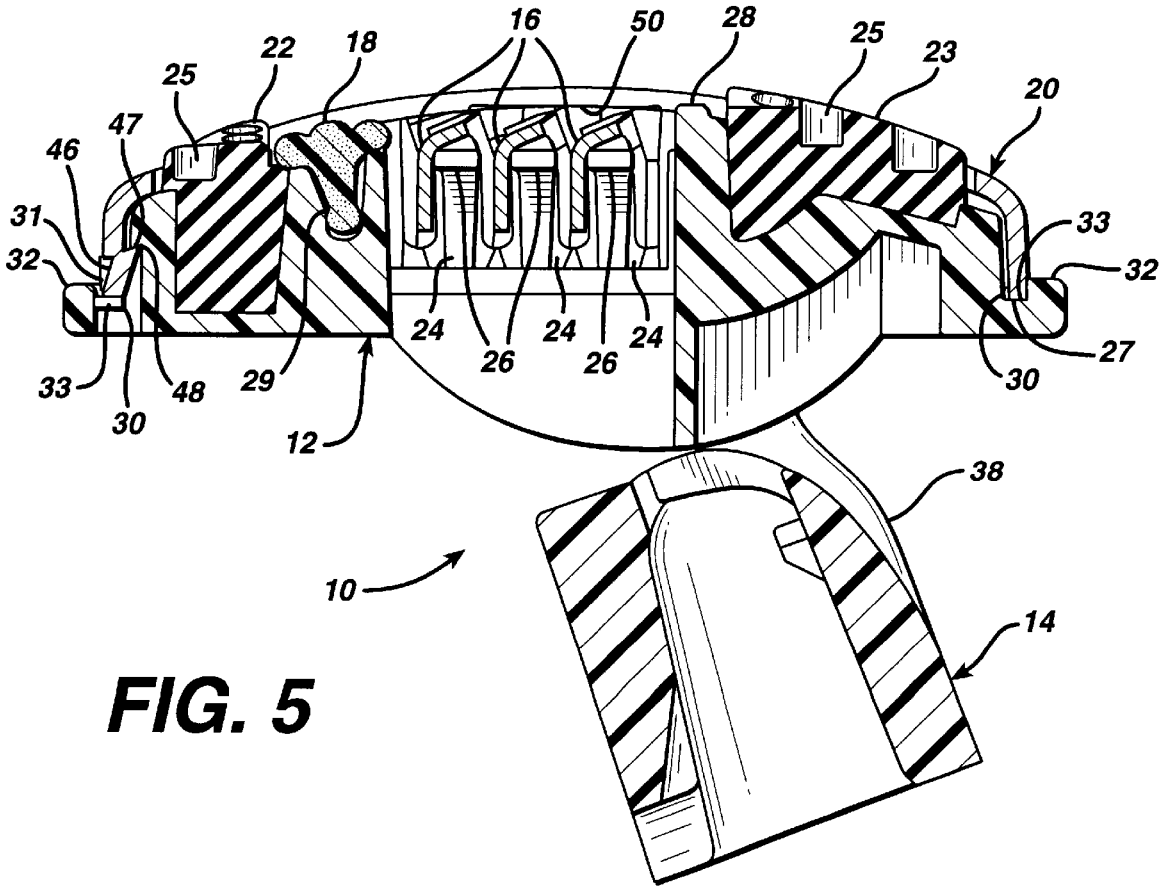
FIG. 5

RAZOR BLADE SYSTEM

BACKGROUND OF THE INVENTION

The present invention relates to a safety razor system and more particularly to a shaving system wherein a replaceable cartridge is provided for connecting a housing containing a plurality of razor blades onto a razor handle by employment of a pivotal connection.

Shaving systems are known wherein a replaceable cartridge contains a housing having a plurality of blades contained therein, the blades being resiliently mounted relative to the housing so as to deflect in response to the contours of the skin during the shaving process. It is also known to pivotably mount the blade-carrying housing to a razor handle by employing a connector member to produce a replaceable cartridge wherein the connector member contains structure for receiving a disconnectable handle in interconnecting engagement. The design and implementation of a structure employing the above features is shown and described in copending PCT Patent Application WO97/37819 (corresponds to U.S. Pat. Nos. 5,787,586; 5,813,293; 5,822,869; 5,855,071; and 5,918,369) and in copending U.S. Ser. No. 08/802,381, (issued as U.S. Pat. No. 5,956,851), each of which is assigned to the assignee of the present invention and herein incorporated by reference.

Razor systems have also been proposed, particularly for use by women, wherein the generally accepted rectangular shape of the razor-carrying housing has been abandoned and replaced by a substantially oval-shaped configuration which is more easily adapted to use in shaving the legs or underarm of the user. In addition, it has been proposed that the plurality of parallel blades disposed in the elongated housing housing member be provided with skin-contacting surfaces at either side thereof which are manufactured of a resilient material having upwardly projecting cup surfaces which serve to stretch the skin during the shaving process and capture a lubricous shaving preparation applied to the skin. The above features are shown and described in PCT Patent Application WO97/17174 assigned to the assignee of the present invention and herein incorporated by reference.

The above-enumerated features all are effective to produce a shaving system which is greatly improved over those of the prior art, when employed under normal conditions. However, it has been found that, in many instances, the razor system may be subjected to abnormal abuse, such as repetitive dropping on tile flooring in the shower, or, in some instances, during carrying of the razor system during travel. Under these conditions, the cutting edge of the razor blades may become slightly misaligned, one with the other, or with the guard bar provided forward of the blade edges, or when employing a pivotal interconnect member as referenced above, the interconnect member and the housing containing the blades may become misaligned. Each of these conditions could affect the ease and comfort of the shaving process that the user would expect from the safety razor system.

It is, therefore, an object of the present invention to provide a shaving system comprising a blade-carrying housing having a guard member parallel with an adjacent blade edge, wherein the designed location of the blade edge relative to a surface of the guard member is maintained during a useful lifetime of the shaving system.

A further object of the invention is to provide a shaving system of the type described wherein retention and location of the various elements of the system is ensured during usage of the system.

Yet another object of the invention is to provide a shaving system having a plurality of parallel blades which are spring-biased which provides improved control over the limitation of blade movement in the biased direction during employment of the system.

Still another object of the invention is to provide a shaving system having a unitary member which is effective to retain a plurality of blades in the system and maintain the blade edges in alignment, one with the other, and with a guard surface disposed parallel to the blades.

Yet another object of the invention is to provide a safety razor system having a blade-carrying housing member and an interconnect member for pivotably attaching the housing to a razor handle wherein the interconnect member is simple in construction and provides ease of attachment to the blade-carrying housing.

SUMMARY OF THE INVENTION

The above objects, and other objects which will become apparent as the description proceeds, are accomplished by providing a safety razor system having an elongated housing with at least one blade extending lengthwise and upwardly from an upper surface of the housing. A unitary retainer member is disposed about the periphery of the housing on an upper surface thereof and contacts opposite ends of the blade or blades. The retainer and housing further have interfitting latch structure supporting the unitary retainer member against upward movement relative to the housing, whereby movement of the blade or blades in the upward direction is restricted by contact with the unitary retainer member.

The housing is substantially of rectangular shape in plan form and has arcuate end portions. The blade means may comprise a plurality of blades, for example, three in number, and the blades may be resiliently biased toward the retainer member.

A guard bar is generally affixed, preferably rigidly affixed, to the upper surface of the housing and extends lengthwise of the housing projecting upwardly in spaced relation with, and parallel to, the plurality of blades. The plurality of blades are generally manufactured of a stainless steel, and the retainer member may be of an aluminum material to inhibit corrosion of the blades.

As a further feature of the invention, the safety razor system is provided with wall structure forming a pair of cavities, one disposed adjacent a lower surface of each end of said housing, and an interconnect member for pivotably connecting the housing onto a razor handle attached to the housing. The interconnect member can be formed integral with the razor handle, as when the shaving unit is supplied as part of a disposable razor, or preferably detachable therefrom so that a fresh housing and interconnect member can be exchanged as with a replaceable razor system. The interconnect member generally comprises a unitary body having a pair of opposed arms at either side thereof extending outwardly lengthwise of the housing and received in a respective cavity on the housing. A pair of first and second opposed coaxial bearing surfaces are disposed at each side of the interconnect member for contacting the housing. Each of a first pair of bearing surfaces is disposed on a respective arm and received in a respective cavity, and each of the second bearing surfaces is disposed on the unitary body inwardly of the first bearing surface, each of the first bearing surfaces being located for contacting a portion of a cavity wall structure and each of the second bearing surfaces being located for contact with an under surface of the housing.

Each of the second bearing surfaces is generally of a greater area than a first bearing surface, and each of the first bearing surfaces may lie entirely within a respective cavity while each of the second bearing surfaces lie entirely outside of a housing cavity.

BRIEF DESCRIPTION OF THE DRAWING

Reference is made to the accompanying drawing in which there is shown an illustrative embodiment of the invention from which its novel features and advantages will be apparent, wherein:

FIG. 5 is an elevational sectional view taken along the line V—V of FIG. 2 showing details of the assembled structure of FIGS. 1 through 3;

FIG. 6 is sectional view taken along the line VI—VI of FIG. 12, shown on an enlarged scale for clarity;

DESCRIPTION OF THE PREFERRED EMBODIMENT

Figure 1:
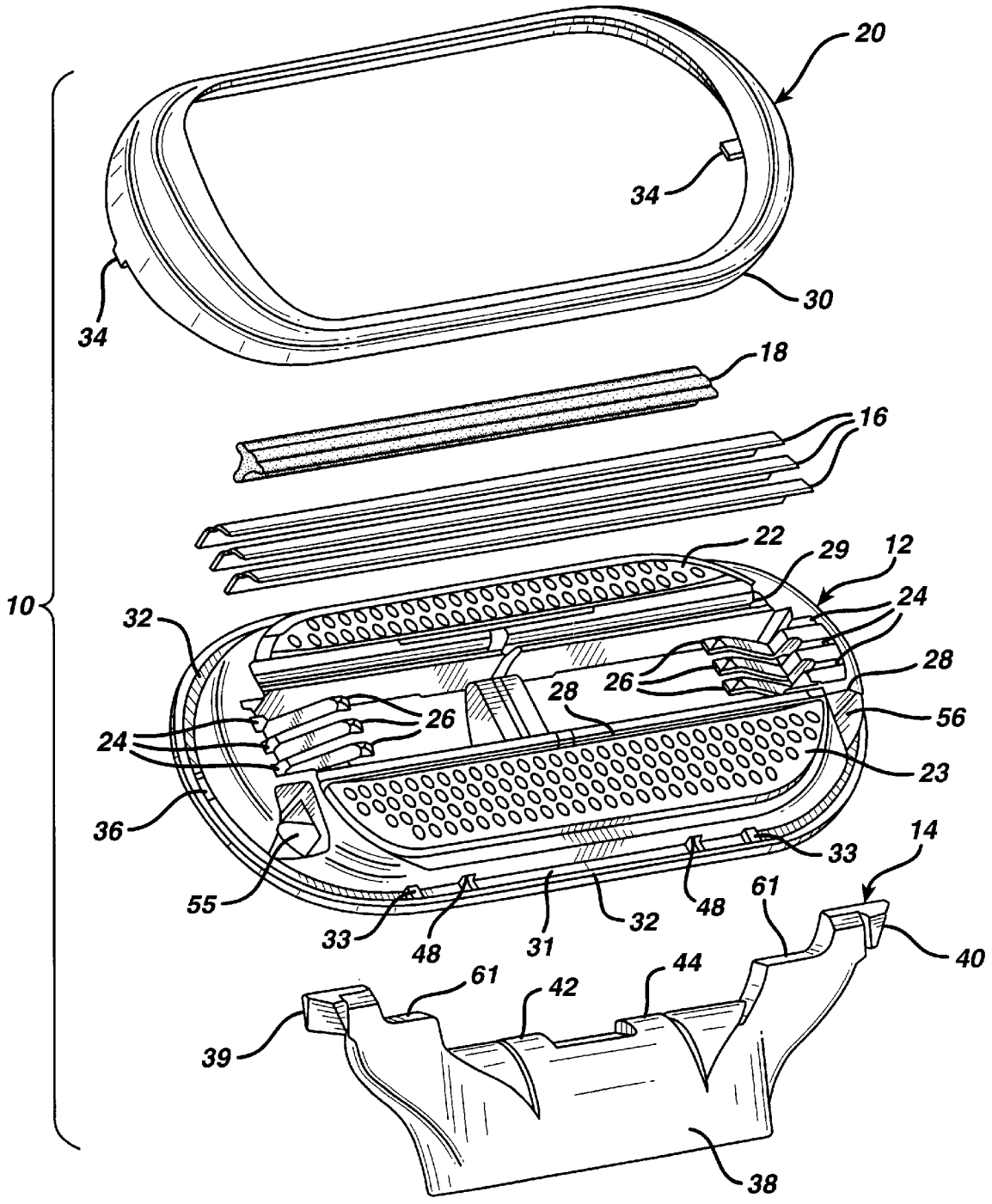
FIG. 1 is a perspective exploded view showing a safety razor system constructed in accordance with the teachings of the present invention.
Figure 2:
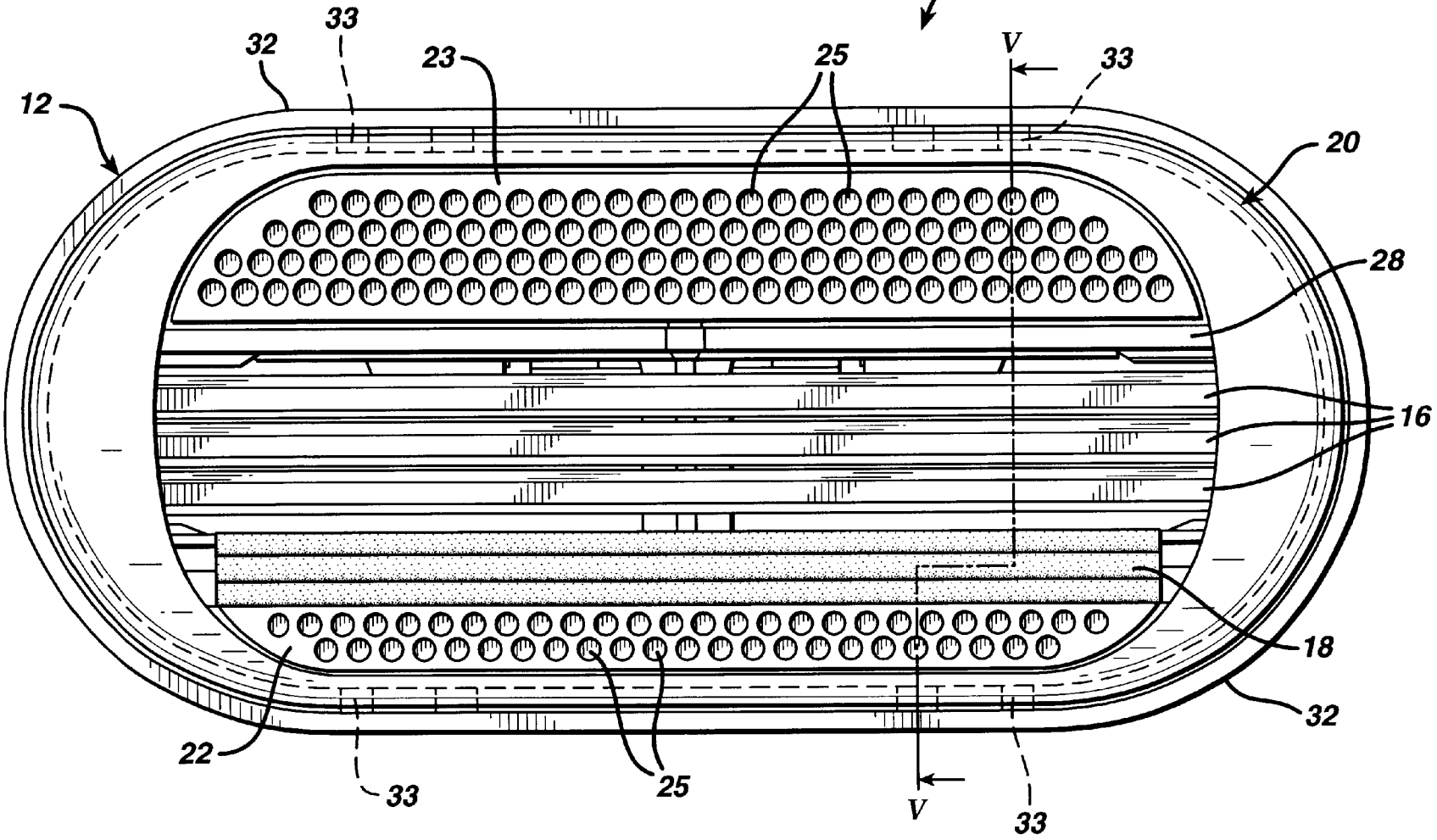
FIG. 2 is top plan view showing the safety razor system in assembled form.

Referring to the drawing and in particular to FIGS. 1 through 4, there is shown a safety razor system 10 comprising an elongated housing 12 and an interconnect member 14. The housing is provided with a plurality of blades 16, three in number, and a shaving aid strip 18 mounted onto the elongated elongated housing behind the blades in a cap position and in parallel relationship with the blades. A unitary annular retainer clip 20 is provided for assembly about the periphery of the housing 12 contacting the ends of the blades 16, in the assembled position.

Referring still to FIGS. 1 through 4 and in particular FIG. 1, the housing 12 is formed of a relatively rigid nonelastomeric thermoplastic material such as sold under the trade name Noryl PX-5511, available from GE Plastics, which suitably bonds with a pair of skin-tensioning portions 22 (which can also be referred to as a cap surface) and 23 of elastomeric material, which may be co-molded (also referred to as two material injection molding) with the basic portion of the housing 12, and which can be molded from an elastomeric plastic, such as sold under the trade name Kraiburg PC 5GIL, available from the Kraiburg Company (Germany), which suitably bonds with the housing 12. The skin-tensioning portions can also be molded from elastomeric materials as is described in detail in U.S. Pat. No. 5,249,361 which is incorporated herein by reference. The skin-tensioning portions 22 and 23 are effective in exerting traction forces on the skin and in simultaneously tensioning the skin on both sides of the blades during the shaving process. The skin-tensioning portions have a plurality of cup-shaped openings 25 formed therein, which are also effective in holding and distributing water and shave gel over large surfaces during wet shaving.

The housing 12 is of substantially rectangular shape in plan form having arcuate end portions, and slots 24 are provided inwardly of each of the end portions for receiving ends of the blades 16 in the assembly of the razor system 10. The blades 16 are manufactured of a stainless-steel material as is well-known in the art, and when received in the slots 24 are biased upwardly by a plurality of spring-biasing elements 26 formed on the housing 12.

A guard member 28 extends parallel to and adjacent the three blades 16 and the skin-tensioning portion 23, the guard member preferably, but not necessarily, being molded as a portion of the housing 12, or in the alternative co-molded with the housing 12 out of a plastic having different characteristics than those of the housing, or may be a separate element rigidly affixed to the housing. Guard member 28 may also include a guard member movable relative to housing 12 as in U.S. Pat. No. 5,063,667 (Jacobson), or the guard member 28 may also include a resilient guard member portion of the type shown in U.S. Pat. No. 5,191,712 (Crook), or U.S. Pat. No. 5,661,907 (Apprille), which are hereby incorporated by reference.

The shaving aid strip 18 is located in the cap region and is a strip-shaped member generally of the type comprising a mixture of a hydrophobic material and a water-leachable hydrophilic polymer material as is described in U.S. Pat. Nos. 5,113,585 and 5,454,164, which are hereby incorporated by reference. The shaving strip aid 18 is received in a slot 29 in the housing 12 and is positioned parallel with the blades 16 and the guard member 28. The shaving aid strip 18 may be held in place through an interference fit with the slot 29, or may be fastened by adhesive or mechanical means.

Figure 12:
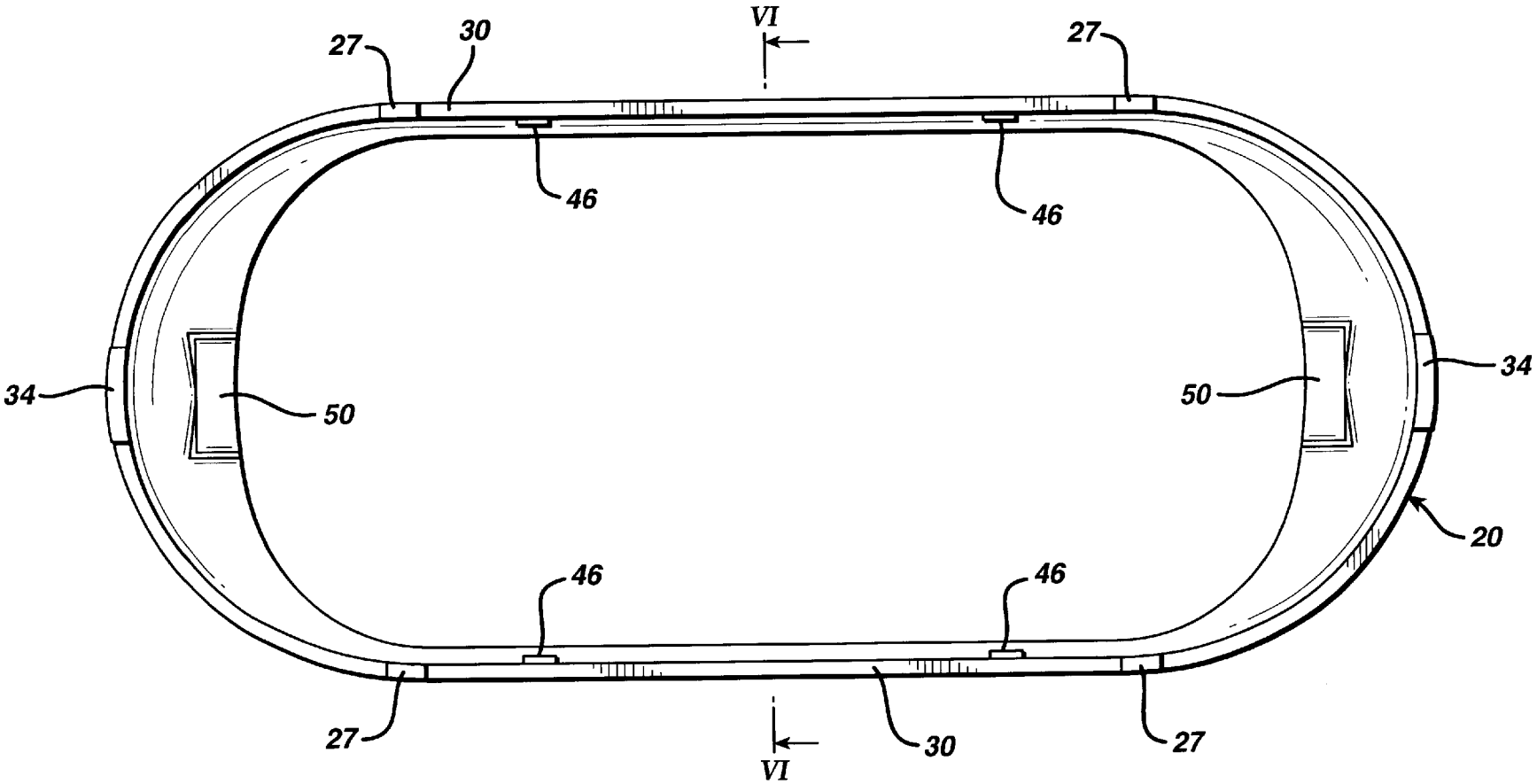
FIG. 12 is a bottom plan view showing details of the unitary annular retainer clip employed in the structure of FIGS. 1 through 3.

The retainer clip 20, which is shown in detail at FIG. 12, is generally manufactured of an aluminum material having a coating, and is of similar shape in plan form as the elongated housing 12, being of rectangular form having arcuate end portions. It is preferred that the coating be on the outer surface and that the clip 20 be uncoated on its underside to provide galvanic protection for the blades. It is preferred that the coating is a polymer coating formed from materials such as polyester, epoxy or two-layer vinyl and polyester systems. The coating can also be an anodized coating. Because the retainer clip 20 surrounds the housing on upper and side surfaces contacting the skin, it is desirable that the coating provide low friction characteristics. As shown in FIG. 12, the retainer clip 20 has four datum surfaces 27 formed such as by coining on the underside thereof at the rim 30, and the elongated housing has four mating datum surfaces 33 which are provided in a groove 31 formed on the lip 32 at the periphery of the housing 12. In the assembled condition the lower edge 30 is received in the groove 31 and the datum surfaces 27 and 33 matingly contact along a predetermined plane. A pair of tabs 34, which provide a latch system for maintaining each of the datum surfaces 27 in contact with a respective. datum surface 33 as will be explained below, extend downwardly through a pair of openings 36 and are bent inwardly, one toward the other, against the underside of the housing 12, to assemble the retainer ring onto the housing 12. If the cartridge is abusively dropped and impacts its top surface, the retainer clip 20 would be urged simply into its seat between the datum surfaces 27 and 33 in groove 31, and the load dispersed into the housing 12. Thus, the load is not transmitted to the tabs 34, allowing the tabs 34 to be relatively small.

As will be noted in FIGS. 5 and 6, the housing upper surface at the skin-tensioning portions 22 and 23 and retainer clip 20 are arcuate in the transverse direction. This provides good skin contour following, especially in an underarm region, and imparts stiffness to the retainer clip 20 to better hold on to the housing 12.

As will be noted from FIGS. 5, 6 and 12, the retainer clip 20 further has a linear coined portion forming a recess which serves as a datum surface 50 for contacting the upper ends of the blades 16, limiting upward movement of the blades relative to the blade guard 28. The datum surfaces 27 and 33 provide the mating surfaces between the retainer clip 20 and the housing 12 at the rim 30, and establish a plane which is parallel to, and at an established distance from, the recess 50, thereby controlling the extent of upward movement of the blades relative to the housing 12 and the blade guard 28.

The interconnect member 14 generally comprises a unitary body 38 having a pair of opposed arms 39 and 40 extending outwardly from the body 38 which are employed to connect the housing 12 onto a razor handle (not shown). The interconnect member 14 is generally manufactured of a semi-rigid plastic material, such as a material sold under the trade name Noryl PX-1265, available from GE Plastics, for suitable strength, and has a pair of slotted V-shaped openings 42 and 44 formed in the upper portion of the body 38. The slotted openings are formed of a configuration to allow movement of the arms 39 and 40 towards one another to the extent that they may be received in the housing 12 during the assembly of the interconnect member onto the housing during manufacture, and thereafter form a permanent connection not intended to be removed.

The lower handle receiving portion of the interconnect member 14 may take various forms depending upon the use of the safety razor system 10. That is, when the razor system is employed as a replaceable cartridge, the structure of the body will be provided with structure as shown, formed to receive a razor handle, such as that described in PCT Patent Application WO97/37819 or in copending U.S. Ser. No. 08/802,381, each of which is herein incorporated by reference and referred to above. However, the razor system may be employed with a handle of a different type, such as the rigid attachment of the body 38 onto, or in unitary formation with, a handle when the system is employed in a discardable razor. In any employment of the safety razor system 10, however, it should be understood that the housing 12 is supported on the interconnect member 14 such that pivotable movement is provided between the housing and the interconnect member during the shaving operation. A spring mounted on the handle and extending through the interconnect member 14 provides a return bias force assisting pivotal movement, as described in WO97/37819.

In the design of the present safety razor system 10 it is necessary that the plurality of blades 16 maintain their cutting edges in proper orientation, one relative to the other, during the shaving process, and that the blades be limited in their upward movement such that they do not extend upwardly beyond the designed limit, relative to the guard member 28. Maintaining proper position of the blades 16 relative to the guard 28 is essential to ensure integrity of the structure and proper operation of the razor system during its useful lifetime.

As referred to above, in order to maintain the datum surfaces 50 at the proper predetermined position, a latch system is provided to ensure maintaining contact between each of the datum surfaces 27 and its respective datum surface 33.

Figure 3:
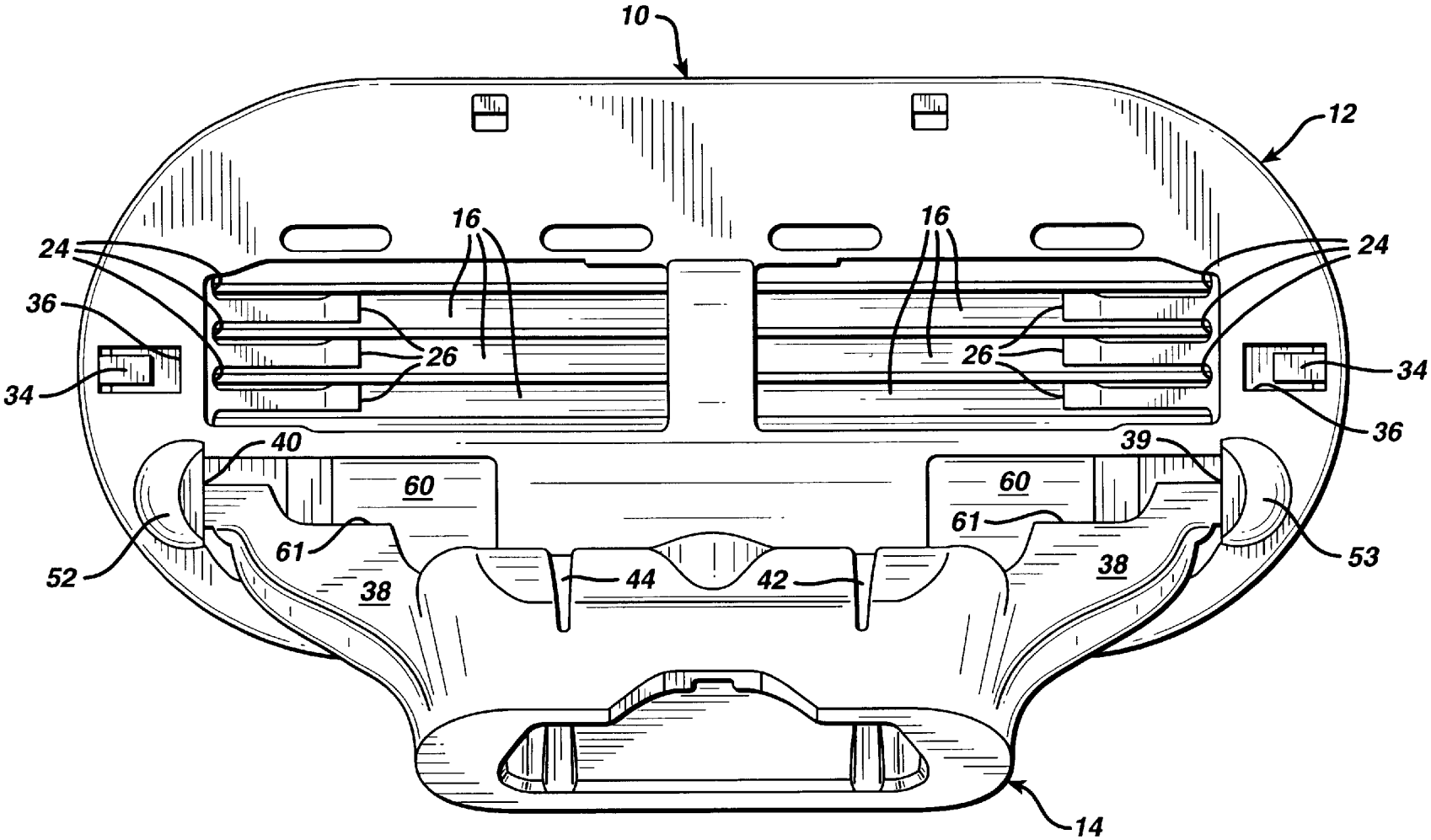
FIG. 3 is a bottom plan view showing the assembled structure of FIGS. 1 and 2 having movable elements thereof positioned differently than as shown in FIG. 2.
Figure 4:
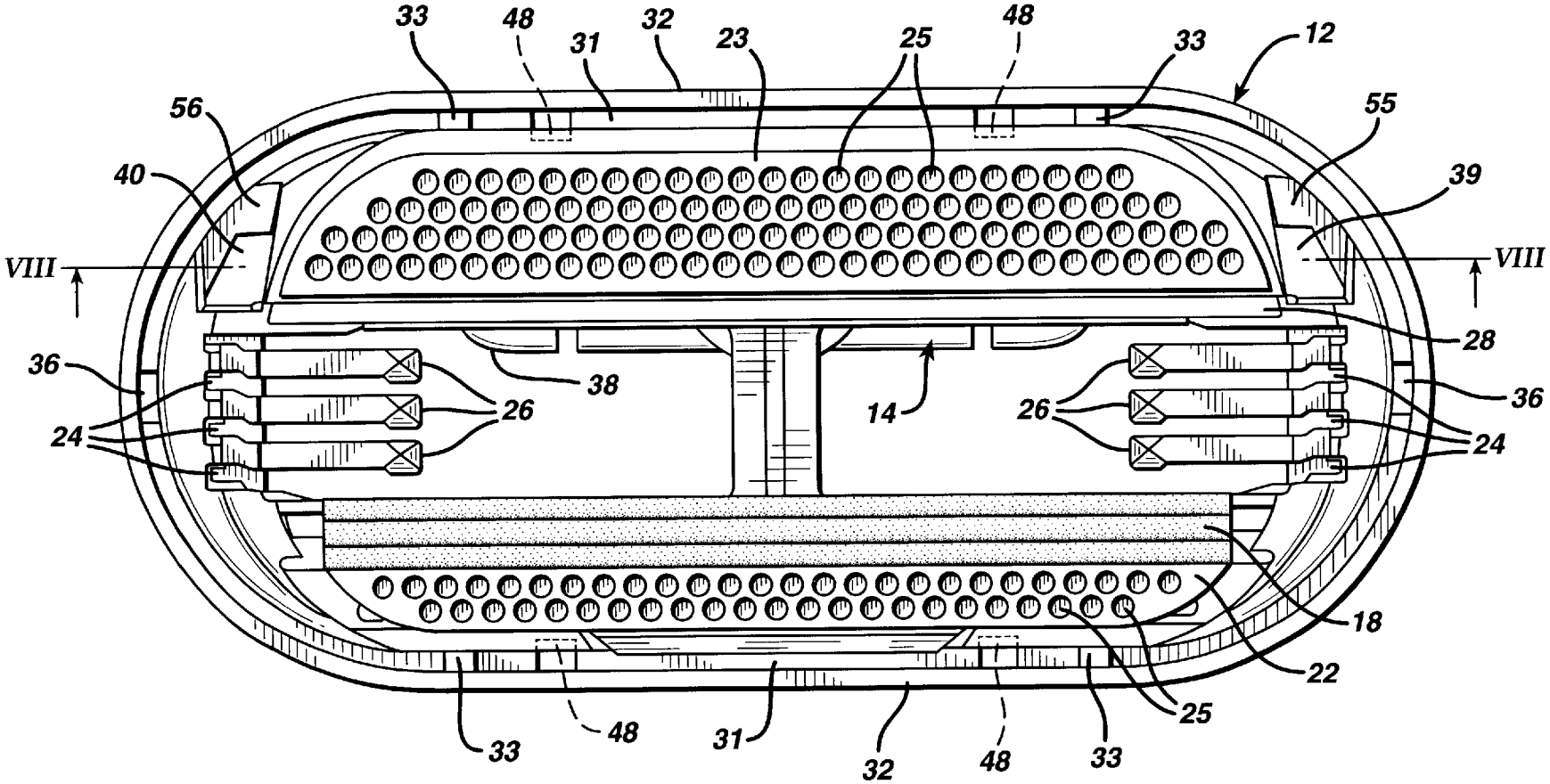
FIG. 4 is a top plan view showing a pair of the elements of FIG. 1 connected to one another as found in the assembled structure.
Figure 7:
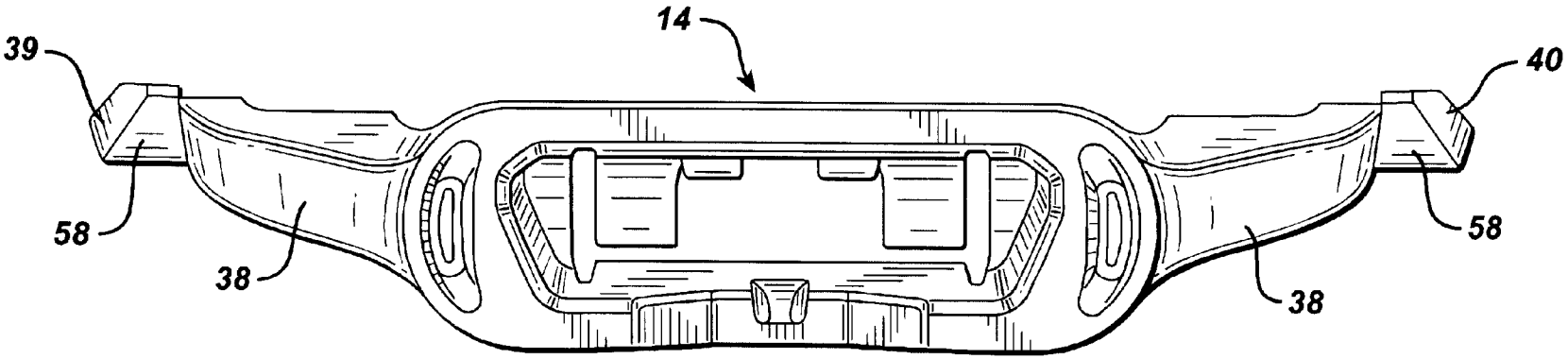
FIG. 7 is a bottom plan view showing details of an element of the structure of FIGS. 1 through 3.

As shown in FIGS. 5 and 6, and FIG. 12, taken in conjunction with FIGS. 1 through 4, in addition to the engagement of the tabs 34 with the housing 12, the latch system provides that the retainer clip 20 can be provided with four coined inwardly extending latch portions 46 having upwardly facing surfaces 47 (two of which are shown in FIGS. 6 and 12) which are spaced symmetrically about the edge 30 of the retainer clip. Four mating downwardly facing detent surfaces 48, shown in FIGS. 1, 4, and 5, are formed in the inner wall of the groove 31 of the housing 12. The retainer clip 20 is constructed such that inwardly extending latch portions 46 of .the edge 30 extend inwardly of the inner wall of the groove 31, which results in the surfaces 47 and 48 being snapped into contact when the retainer clip 20 is received onto the housing 12. Since latching surface 47, 48 can contribute to restraining the clip 20 from separating from housing 12, the tabs 34 that are bent into slots 36 can, therefore, be made relatively small.

While the present latch system, as shown, employs latch elements including both the pair of tabs 34 mating with the bottom surface of the housing 12 and the latching surfaces 47 and 48, it should be understood that a more simple latch system may be employed, as is presently preferred, by utilizing only the two tabs 34 which are assembled as described above, when it is deemed that only that portion of the system is needed. That is, the latch portions 46 may be eliminated from the retainer clip 20 and the latching surfaces 47 and 48 deleted from the housing 12 when only the tabs 34 are needed to maintain the datum surfaces 27 and 33 in continuous contact.

Figure 8:
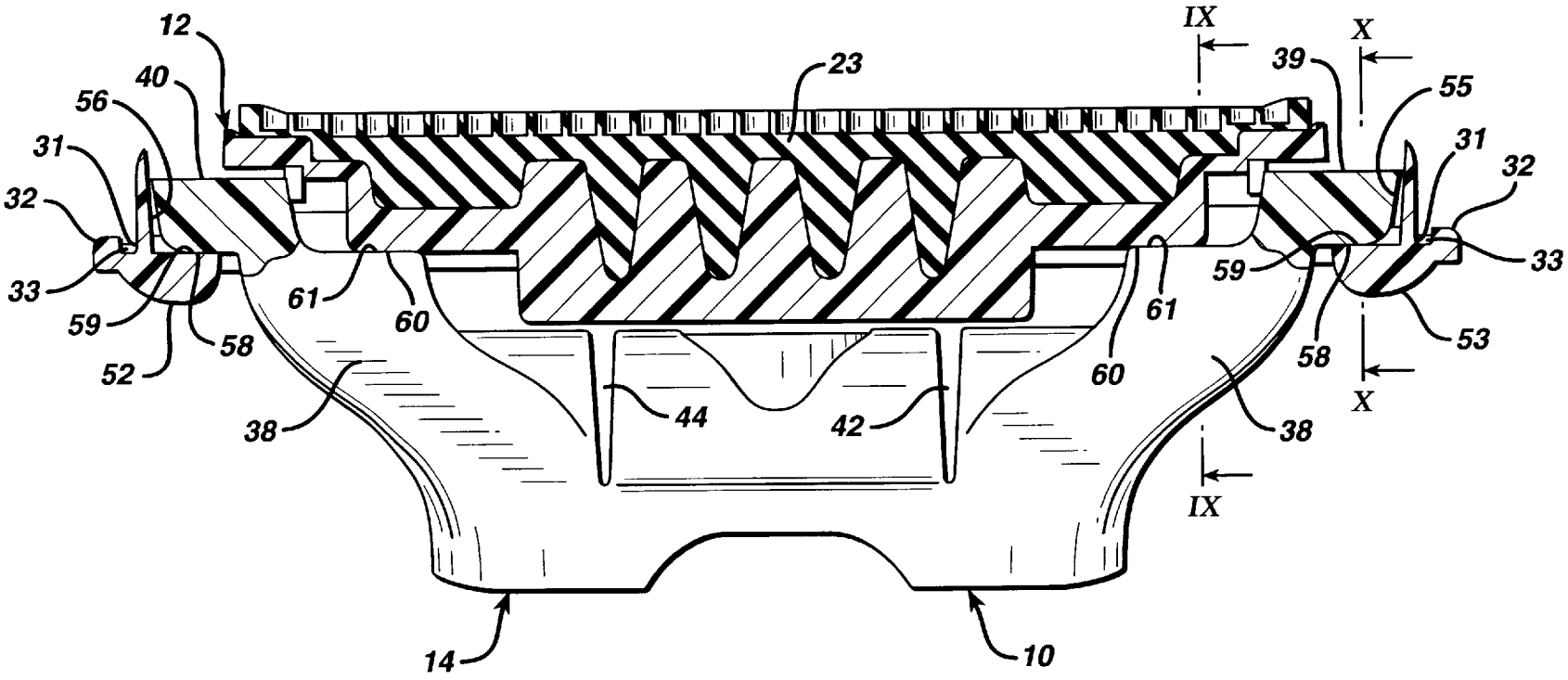
FIG. 8 is an elevational sectional view taken along the line VIII—VIII of FIG. 4 showing further details of the assembled structure of FIGS. 1 through 3.

Referring now to FIGS. 3 and 7 through 11, the bottom surface of the housing 12, as shown in FIG. 3, has a pair of bosses 52 and 53 formed thereon, and a pair of recesses 55 and 56 are formed in the wall structure of the housing for receiving the arms 39 and 40. As best shown in FIG. 8, the slots 42 and 44 combined with the choice of a flexible plastic material as set forth above, allow for simple assembly, one time only during manufacturing, of the interconnect member 14 onto the housing 12 through insertion of the arms 39 and 40 into the respective cavities 55 and 56 when the arms are compressed inwardly towards one another, and allowed to assume the position shown in FIG. 8 upon release. This allows assembly and retention of pivotably interconnected members retained securely as an assembly unit, and thereafter the blades can be inserted and retained by the retainer clip 20.

Figure 10:
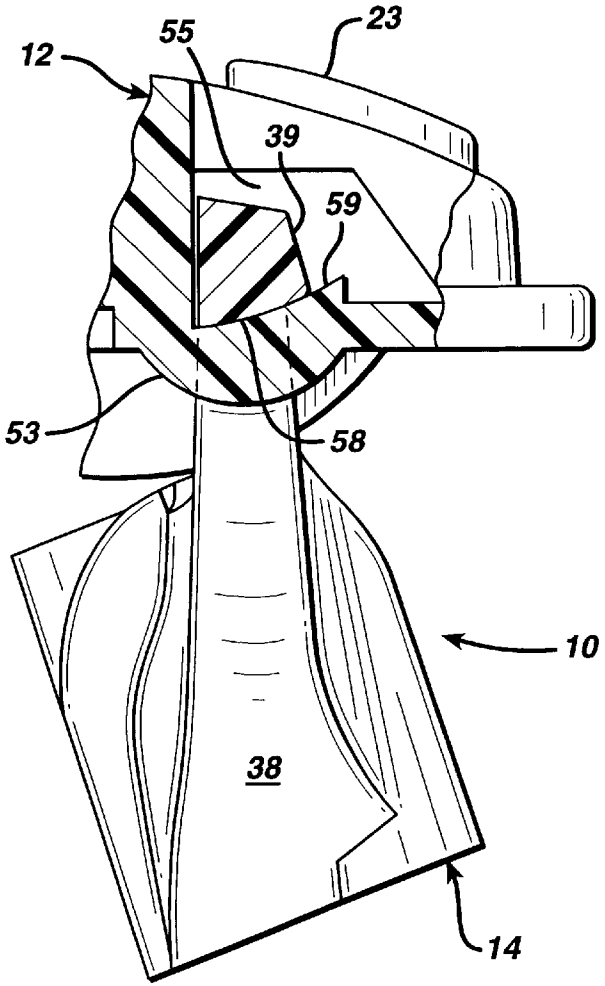
FIG. 10 is a fragmentary sectional view taken along the line X—X of FIG. 8 showing, on an enlarged scale, another portion of the assembled structure of FIGS. 1 through 3.
Figure 9:
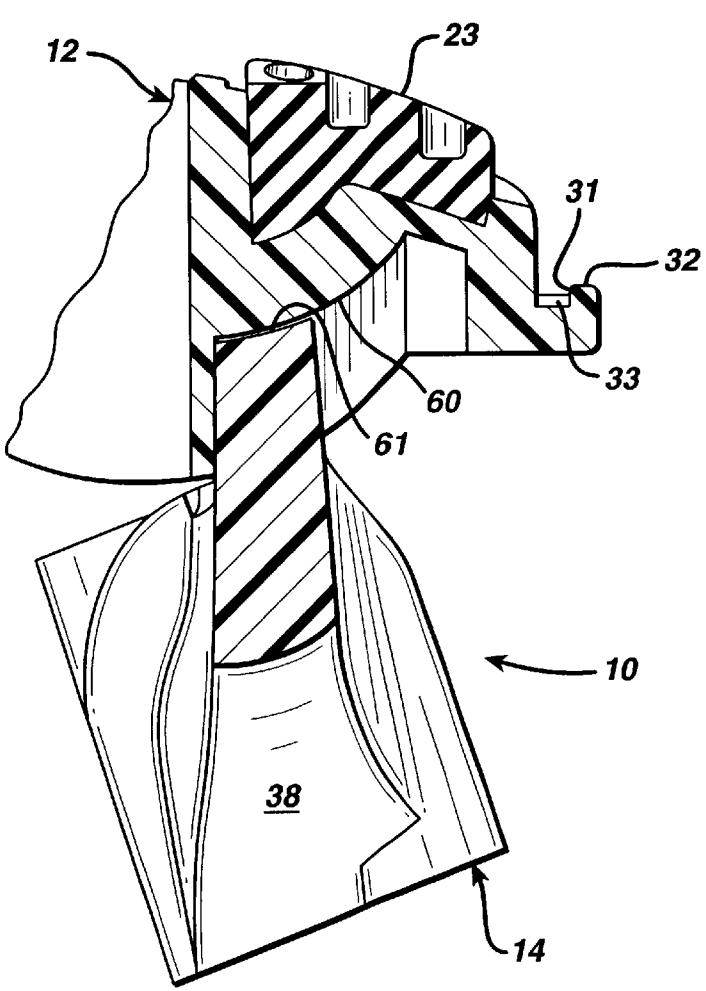
FIG. 9 is a fragmentary sectional view taken along the line IX—IX of FIG. 8 showing, on an enlarged scale, a portion of the assembled structure of FIGS. 1 through 3 in detail.

However, this simple form of assembly requires that the arms 39 and 40 be relatively small and, therefore, prohibits the provision of large bearing surfaces within the cavity 55 or 56, as best shown in FIGS. 9 and 10 taken in conjunction with FIG. 8. As upward forces tending to pull the housing 12 away from the interconnect member 14 are generally small, either during the shaving process or in the event of dropping the razor system 10 onto a hard surface, the present structure provides a pair of coaxial first bearing surfaces 58 and 59, at either side of the interconnect member 14, lying wholly within cavity 55 or 56 which absorb only upward forces, and second bearing surfaces 60 and 61 lying outside of the cavity which absorb the greater downward or compressive forces. That is, the greater force produced during the shaving process, or due to dropping of the razor system 10, is absorbed by the larger bearing surfaces 60 and 61 which are not so limited as to surface area as the bearing surfaces 58 and 59 which of necessity are smaller due to their location within the cavities 55 and 56. On the interconnect member 14, the first bearing surfaces 58 are downwardly facing and the second bearing surfaces 61 are upwardly facing.

Figure 11:
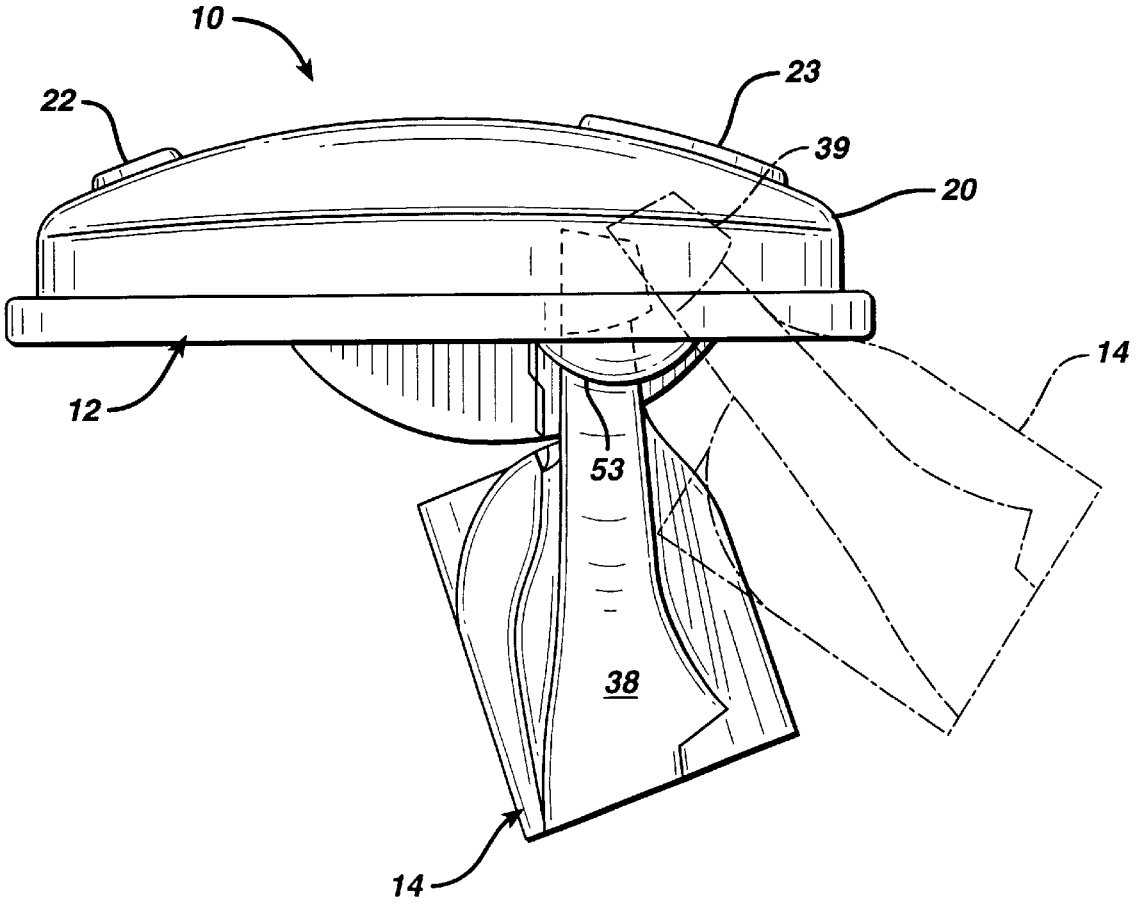
FIG. 11 is an elevational side view of the assembled structure of FIGS. 1 through 3 showing relative movement of the elements of the assembly during usage in the shaving process.

As shown in FIG. 11, with the structural location of the bearings 58, 59, 60 and 61, as described above, the elongated housing 12 is free to rotate about a virtual axis which is located substantially in the vicinity of the guard member 28. It is presently preferred that this virtual pivot axis is in front of the cutting edge of the primary blade and in proximity to or below a plane tangent to the leading and trailing blade cutting edges, as observed in an unloaded state free of cutting forces.

From the above it should be evident that the razor system 10 includes structure which is simple to manufacture and assemble, and which will withstand the rigors of inadvertent dropping or other mishaps which might tend to misalign the blades 16 or cause the interconnect member to become dislodged from the housing 12. By providing a latch system as set forth above, the retainer ring 20 is fixed within the lip 32 in a manner to retain the blades 16 in the proper position relative to the guard member 28, due to contact between the datum surfaces 27, 33 and 50. The employment of a unitary member having arcuate ends as in the construction of the retainer ring 18 serves to provide rigidity to the structure. Further, the providing of a retainer clip 20, manufactured of aluminum material, provides a sacrificial metal source when combined with the stainless steel blades, thus inhibiting corrosion of the steel blades. The upper exposed surface of the clip 20 can be coated to provide desirable surface features for aesthetics, or can be coated with a low friction coating.

The use of the retainer clip 20 allows a more ruggedized, permanent connection of the blade housing 12 to the interconnect member, whereby the assembly is connected together once and then it resists disconnecting, such as in dropping. The retainer clip 20 is dedicated to permanently securing the parts to the blade housing, and the arms on the interconnect are strengthened to include two pairs of inboard and outboard bearing surfaces dedicated to resisting separation by impact loads.

Further, the assembly of the interconnect, member 14 to the housing 12 is of simple construction, and the location of the coaxial bearing surfaces produces a pair of connected members which are capable of maintaining integrity of the structure during extreme usage. The retainer clip 20 does not secure the pivotably interconnected member 14 to blade housing 12, so the bearing area can be made larger to absorb the load of abusive dropping of a relatively large cartridge.

While it is apparent that changes and modifications can be made within the spirit and scope of the present invention, it is our intention, however, only to be limited by the appended claims.

As our invention we claim:

1. A safety razor system comprising an elongated housing having a plurality of shaving blades disposed thereon, each said blade having a cutting edge extending lengthwise and upwardly from an upper surface of said housing;

a unitary annular retainer member formed of sheet metal material and disposed substantially circumferentially about the upper periphery of said housing and contacting opposite ends of each of said plurality of shaving blades;

said housing comprising an upwardly extending lip forming an upwardly opening groove disposed about the periphery of said housing, and wherein said retainer member is disposed in said groove; and a latch disposed on said retainer member adapted to attach to a mating portion within said groove of said housing member to restrain said retainer member against upward movement relative to said housing, said latch depending downwardly from said retainer member and being permanently deformed to position said housing between said latch and said retainer member, whereby movement of each said blade cutting edge of said plurality of shaving blades in the upward direction is restricted by contact with said unitary retainer member.

2. A safety razor system as set forth in claim 1 wherein said housing is substantially of rectangular shape in plan form having arcuate end portions.

3. A safety razor system as set forth in claim 1 wherein said retainer member is arcuate in the transverse direction.

4. A safety razor system as set forth in claim 1 wherein each said cutting edge of said plurality of blades is oriented in the same direction.

5. A safety razor system as set forth in claim 1 wherein said plurality of blades are three in number.

6. A safety razor system as set forth in claim 1 wherein said retainer member has a pair of datum surfaces formed therein, each of said datum surfaces comprising a downwardly facing planar surface for contacting respective ends of said plurality of blades.

7. A safety razor system as set forth in claim 1 which further includes a guard bar disposed on said housing, said guard bar being separate from said annular retainer member and extending lengthwise of said housing and projecting upwardly in spaced relation with, and parallel to, said plurality of blades and cooperating to determine an exposure of a forewardmost blade of said plurality.

8. A safety razor system as set forth in claim 1 wherein said plurality of blades is resiliently biased toward said retainer member.

9. A safety razor system comprising:

an elongated housing having at least one shaving blade disposed thereon, each said at least one blade having a cutting edge extending lengthwise and upwardly from an upper surface of said housing;

a unitary retainer member disposed about the upper periphery of said housing and contacting opposite ends of each said shaving blade;

wherein said housing comprises an upwardly extending lip forming an upwardly opening groove disposed about the periphery of said housing, and wherein said retainer member is disposed in said groove; and a latch disposed on said retainer member adapted to attach to a mating portion of said housing member to restrain said retainer member against upward movement relative to said housing, whereby movement of each said blade cutting edge in the upward direction is restricted by contact with said unitary retainer member, and wherein said latch on said retainer comprises a plurality of tab elements and said mating portion of said housing comprises a plurality of slots formed on said housing extending inward of said lip, wherein said tabs are interlocked into said slots for positioning and supporting said retainer member within said groove relative to said housing.

10. A safety razor system comprising:

an elongated housing having at least one shaving blade disposed thereon, each said at least one blade having a cutting edge extending lengthwise and upwardly from an upper surface of said housing;

a unitary retainer member disposed about the upper periphery of said housing and contacting opposite ends of each said shaving blade; and a latch disposed on said retainer member adapted to attach to a mating portion of said housing member to restrain said retainer member against upward movement relative to said housing, whereby movement of each said blade cutting edge in the upward direction is restricted by contact with said unitary retainer member, wherein said housing comprises an upwardly extending lip forming an upwardly opening groove disposed about the periphery of said housing, and wherein said retainer member is disposed in said groove, and wherein said mating portion comprises a plurality of downwardly facing detent surfaces formed on said housing within said groove and said latch of said retainer member comprises a plurality of upwardly facing surfaces contacting said detent surfaces for positioning and supporting said retainer member relative to said housing.

11. A safety razor system comprising:

an elongated housing having at least one shaving blade disposed thereon, each said at least one blade having a cutting edge extending lengthwise and upwardly from an upper surface of said housing;

a unitary retainer member disposed about the upper periphery of said housing and contacting opposite ends of each said shaving blade;

wherein said housing comprises an upwardly extending lip forming an upwardly opening groove disposed about the periphery of said housing, and wherein said retainer member is disposed in said groove; and a latch disposed on said retainer member adapted to attach to a mating portion of said housing member to restrain said retainer member against upward movement relative to said housing, said latch depending downwardly from said retainer member and being permanently deformed to position said housing between said latch and said retainer member, whereby movement of each said blade cutting edge in the upward direction is restricted by contact with said unitary retainer member; and wherein said retainer member is formed of sheet metal material electrically conductive with said shaving blade.

12. A safety razor system as set forth in claim 1 wherein said plurality of blades are stainless steel and said retainer member comprises aluminum.

13. A safety razor system as set forth in claim 1 which further includes a pair of elastomeric surfaces, one surface disposed on either side of said blades for tensioning the skin during shaving.

14. A safety razor system comprising:

an elongated housing having at least one shaving blade disposed thereon, each said at least one blade having a cutting edge extending lengthwise and upwardly from an upper surface of said housing;

a unitary retainer member disposed about the upper periphery of said housing and contacting opposite ends of each said shaving blade; and a latch disposed on said retainer member adapted to attach to a mating portion of said housing member to restrain said retainer member against upward movement relative to said housing, whereby movement of each said blade cutting edge in the upward direction is restricted by contact with said unitary retainer member, and which further includes a pair of elastomeric surfaces, one surface disposed on either side of said blade for tensioning the skin during shaving, and wherein said elastomeric surfaces have a plurality of cup-shaped openings formed therein.

15. A safety razor system comprising:

an elongated housing having at least one shaving blade disposed thereon, each said at least one blade having a cutting edge extending lengthwise and upwardly from an upper surface of said housing;

a unitary retainer member disposed about the upper periphery of said housing and contacting opposite ends of each said shaving blade; and a latch disposed on said retainer member adapted to attach to a mating portion of said housing member to restrain said retainer member against upward movement relative to said housing, whereby movement of each said blade cutting edge in the upward direction is restricted by contact with said unitary retainer member, said housing comprising wall structure forming a pair of cavities, one disposed adjacent a lower surface of each end of said housing;

an interconnect member for pivotably connecting said housing to a razor handle;

said interconnect member comprising a unitary body having a pair of opposed arms at either side thereof extending outwardly lengthwise of said housing; and a pair of first and second opposed coaxial bearing surfaces disposed at each side of said interconnect member body for contacting said housing;

each of said first bearing surfaces being disposed on a respective arm and received in a respective said cavity and each of said second bearing surfaces being disposed on said body inwardly of said first bearing surfaces;

each said first bearing surface being located for contacting a portion of a said cavity wall structure and each said second bearing surface being located for contact with an under surface of said housing.

16. A safety razor system as set forth in claim 15 wherein each said second bearing surface is of a greater area than said first bearing surface.

17. A safety razor system as set forth in claim 15 wherein each said first bearing surface lies entirely within a respective cavity.

18. A safety razor system as set forth in claim 15 wherein each said second bearing surface lies entirely outside of a said cavity.

19. A safety razor system as set forth in claim 15 wherein said interconnect member body has at least one slot formed therein between said arms to facilitate movement of said arms one toward the other by flexure of said body.

20. A shaving unit comprising an elongated housing member having at least one shaving blade disposed thereon extending lengthwise and upwardly from an upper surface of said housing member;

wall structure formed on said housing forming a pair of cavities, one disposed adjacent a lower surface of each end of said housing;

an interconnect portion adapted to establish a pivotal connection between said housing and a razor handle;

said interconnect portion comprising a unitary body having a pair of opposed arms at either side thereof extending outwardly lengthwise of said housing; and a pair of first and second opposed coaxial bearing surfaces disposed at each side of said interconnect body member for contacting said housing;

each of said first bearing surfaces being disposed on a respective arm and received in a respective said cavity and each of said second bearing surfaces being disposed on said body inwardly of said first bearing surfaces;

each said first bearing surface being located for contacting a portion of said wall structure and each said second bearing surface being located for contact with an under surface of said housing.

21. A shaving unit as set forth in claim 20 wherein each said second bearing surface is of a greater area than said first bearing surface.

22. A shaving unit as set forth in claim 20 wherein each said first bearing surface lies entirely within a respective cavity.

23. A shaving unit as set forth in claim 20 wherein each said second bearing surface lies entirely outside of a said cavity.

24. A shaving unit as set forth in claim 20 wherein said interconnect portion body has at least one slot formed therein between said arms to facilitate movement of said arms one toward the other by flexure of said body.

25. A shaving unit as set forth in claim 20 wherein said interconnect portion body comprises handle connecting structure for attaching a razor handle, whereby said shaving unit is configured as a separable cartridge.

26. A shaving unit as set forth in claim 20 wherein said housing is substantially of rectangular shape in plan form having arcuate end portions.

27. A shaving unit as set forth in claim 20 wherein said at least one shaving blade comprises a plurality of blades in spaced relation, each extending lengthwise of said housing.

28. A shaving unit as set forth in claim 27 wherein said plurality of shaving blades are three in number.

29. A shaving unit as set forth in claim 20 wherein said housing comprises an upwardly extending lip forming an upwardly opening groove disposed about the periphery of said housing and further comprising a retainer member disposed in said groove on an upper surface of said housing and contacting opposite ends of said at least one shaving blade.

30. A shaving unit as set forth in claim 27 further comprising a retainer member disposed on an upper surface of said housing and contacting opposite ends of each of said plurality of blades and wherein said retainer member has a pair of datum surfaces formed therein, each of said datum surfaces having a downwardly facing planar surface for contacting respective ends of said plurality of shaving blades.

31. A shaving unit as set forth in claim 27 which further includes a guard bar disposed on said housing, said guard bar extending lengthwise of said housing and projecting upwardly in spaced relation with and parallel to said plurality of shaving blades.

32. A shaving unit as set forth in claim 27 wherein each of said plurality of shaving blades is resiliently biased toward said retainer member.

33. A shaving unit as set forth in claim 20 further comprising a retainer member disposed about the periphery of said housing on an upper surface thereof and contacting opposite ends of said at least one shaving blade, and a latch member disposed on said retainer member adapted to attach to a mating portion of said housing member to restrain said retainer member against upward movement relative to said housing, whereby movement of each cutting edge of each said shaving blade in the upward direction is restricted by contact with said retainer member.

34. A shaving unit as set forth in claim 33 wherein said latch on said retainer member comprises a plurality of tab elements and said mating portion of said housing comprises a plurality of slots, whereby said tabs are interlocked into said slots for positioning and supporting said retainer member relative to said housing.

35. A shaving unit as set forth in claim 20 wherein said retainer member is formed of sheet metal material.

36. A shaving unit as set forth in claim 27 wherein said plurality of blades are stainless steel and said retainer member comprises aluminum.

37. A shaving unit as set forth in claim 20 which further includes a pair of elastomeric surfaces, one disposed on either side of said plurality of blades for tensioning the skin during the shaving process.

38. A unitary annular retainer clip for assembly onto a wet shaving razor housing receiving razor blades, comprising:

an annular body having upper and under surfaces and a pair of opposed longitudinal portions and a pair of opposed lateral portions joined thereto defining a blade-receiving pocket therebetween having an inner peripheral annular margin;

an annular rim depending from the annular body longitudinal and lateral portions, the annular rim defining between sides thereof a razor housing-receiving pocket;

a first plurality of at least three downwardly directed planar first datum surfaces formed at respective first discrete locations on the under surface of the longitudinal portions and extending along the longitudinal portions towards the lateral portions, the first discrete locations being at a different elevation relative adjacent regions of the under surface and having a collective area less than a majority of a surface area of the under surface;

a plurality of latch elements formed on the under surface, said latch elements being positionable at least partially upwardly facing and also being in spaced relation to the first plurality of datum surfaces, whereby the latch elements restrain the annular retainer clip from movement relative to an object positioned within the annular rim and between the latch elements and the under surface; and a second plurality of downwardly directed elongated planar second datum surfaces formed at respective second discrete locations disposed on the under surface of both the opposed lateral portions adjacent the inner peripheral margin of the blade-receiving pocket for contacting respective blade ends and extending generally parallel to the lateral portions, the second discrete locations being at a different elevation relative adjacent regions of the under surface;

whereby during assembly of the annular retainer clip onto a housing containing razor blades, the second plurality of datum surfaces and therewith the upward location of the razor blades are positioned at a spatial orientation relative to the housing determined by the first plurality of datum surfaces.

39. A unitary annular retainer clip for assembly onto a wet shaving razor housing, comprising:

an annular body having upper and under surfaces and a pair of opposed longitudinal portions and a pair of opposed lateral portions joined thereto defining a blade-receiving pocket therebetween having an inner peripheral annular margin;

a first plurality of downwardly directed planar first datum surfaces formed on the under surface of the longitudinal portions and extending along the longitudinal portions towards the lateral portions, the first datum surfaces being distributed on both sides of a medial plane dividing the pair of longitudinal portions and having a collective area that is substantially less than an area of the under surface on which the first datum surfaces are disposed;

a plurality of latch elements formed on the under surface, said latch elements being permanently deformable to an at least partially upwardly facing position and also being in spaced relation to the first plurality of datum surfaces, whereby the latch elements restrain the annular retainer clip from movement relative to an object positioned between the latch elements and the under surface; and a second plurality of downwardly directed elongated planar second datum surfaces formed on the under surface of the lateral portions adjacent the inner peripheral margin of the blade-receiving pocket and extending generally parallel to the lateral portions;

whereby during assembly of the annular retainer clip onto a housing containing razor blades, the second plurality of datum surfaces is positioned at a spatial orientation relative to the housing determined by the first plurality of datum surfaces, and wherein the retainer clip is formed of sheet metal material.

40. An annular retainer clip as set forth in claim 38 wherein said retainer clip is arcuate in the transverse direction.

41. An annular retainer clip as claimed in claim 39, wherein the metal material is coated on the upper surface forming smooth skin-contacting surfaces upon assembly into a razor housing, the metal material being substantially uncoated on the under surface so as to be electrically conductive.

42. An annular retainer clip as claimed in claim 39, wherein the metal material comprises aluminum.

43. An annular retainer clip as claimed in claim 38, wherein the plurality of first datum surfaces is at least three in number, the first datum surfaces being distributed on both sides of a medial plane dividing the pair of longitudinal portions.

44. An annular retainer clip as claimed in claim 38, wherein the plurality of second datum surfaces is two in number.

45. An annular retainer clip as claimed in claim 38, wherein the second discrete locations of the second datum surfaces are recessed relative adjacent regions of the under surface.

46. An annular retainer clip as claimed in claim 38, wherein the plurality of downwardly directed first datum surfaces is formed on a lowermost margin of the annular rim.

47. An annular retainer clip as claimed in claim 38, wherein said latch elements comprise a plurality of tabs spaced inwardly from said upper surface.

48. An annular retainer clip as claimed in claim 38, wherein said latch elements comprise a plurality of snap-fit latch elements extending at least partially parallel to said upper surface and spaced downwardly therefrom.

49. An annular retainer clip as claimed in claim 38 in combination with a razor housing forming a safety razor system, the razor housing comprising:

a plurality of upwardly directed datum surfaces adapted for contacting the plurality of retainer clip first datum surfaces; and at least one shaving blade disposed thereon extending lengthwise and upwardly from an upper surface of the housing, wherein the retainer clip plurality of second datum surfaces contacts respective ends of the at least one blade.

50. A safety razor system as claimed in claim 49, wherein the at least one blade is resiliently biased toward the retaining clip.

51. A safety razor system as claimed in claim 49, wherein said at least one shaving blade comprises a plurality of blades in spaced relation, each extending lengthwise of said retainer clip longitudinal portions, opposite ends of each of the plurality of blades being contacted by said plurality of second datum surfaces.

52. A safety razor system as claimed in claim 49, wherein the housing further comprises a guard member disposed thereon, the guard member extending lengthwise and projecting upwardly in spaced relation to the plurality of housing datum surfaces and in spaced relation to the at least one blade, wherein upon assembly of the annular retainer clip onto the housing a spatial orientation, as measured in a nonshaving condition free of forces of shaving, of a cutting edge of the at least one blade to the guard member is set by the retainer clip second datum surfaces.

53. A safety razor system as claimed in claim 52, wherein the at least one blade is resiliently biased toward the retaining clip.

54. A safety razor system as claimed in claim 52, wherein the guard member comprises a fixed guard portion in fixed spaced relation to the plurality of housing datum surfaces.

55. A safety razor system comprising:

an elongated housing having at least one shaving blade disposed thereon, each said at least one blade having a cutting edge extending lengthwise and upwardly from an upper surface of said housing, said housing upper surface having at least two skin-engaging surfaces disposed respectively before and behind said at least one blade;

a unitary annular retainer member having a pair of opposed longitudinal portions and a pair of opposed lateral portions joined thereto defining an open pocket therebetween and having an annular rim depending from the annular body longitudinal and lateral portions, the annular rim defining between sides thereof a razor housing-receiving pocket, said annular retainer member being disposed substantially circumferentially about the periphery of said housing in front of and behind said at least two skin-engaging surfaces and contacting opposite ends of each said blade, said open pocket substantially unobstructing the at least two skin-engaging surfaces projecting upwardly from the housing; and a latch disposed on said retainer member adapted to attach to a mating portion of said housing member to restrain said retainer member against upward movement relative to said housing, said latch depending downwardly from said retainer member and being permanently deformed to position said housing within the annular rim and between the latch and the retainer member;

wherein said housing is substantially of rectangular shape in plan form having arcuate end portions;

said housing upper surface and said retainer member being arcuate in the transverse direction, and said retainer member substantially overlying the housing peripheral upper, side and end surfaces, thereby forming a substantially continuous skin contacting surface with the at least two skin-engaging surfaces of the housing.

56. A safety razor system as set forth in claim 55 wherein said at least one shaving blade comprises a plurality of blades in spaced relation, each extending lengthwise of said member.

57. A safety razor system as set forth in claim 56 wherein each said cutting edge of said plurality of blades is oriented in the same direction.

58. A safety razor system as set forth in claim 56 which further includes a guard bar disposed on said housing, said guard bar being separate from said annular retainer member and extending lengthwise of said housing and projecting upwardly in spaced relation with, and parallel to, said plurality of blades and cooperating to determine an exposure of a forewardmost blade of said plurality.

59. A safety razor system as set forth in claim 56 wherein said plurality of blades is resiliently biased toward said retainer member.

60. A safety razor system comprising:

an elongated housing having at least one shaving blade disposed thereon, each said at least one blade having a cutting edge extending lengthwise and upwardly from an upper surface of said housing;

a unitary annular retainer member disposed substantially circumferentially about the periphery of said housing and contacting opposite ends of each said blade and having an annular rim depending from the annular body longitudinal and lateral portions, the annular rim defining between sides thereof a razor housing-receiving pocket; and a latch disposed on said retainer member adapted to attach to a mating portion of said housing member to restrain said retainer member against upward movement relative to said housing, said latch depending downwardly from said retainer member and being permanently deformed to position said housing within the annular rim and between the latch and the retainer member;

wherein said housing is substantially of rectangular shape in plan form having arcuate end portions;

said housing upper surface and said retainer member being arcuate in the transverse direction, and said retainer member substantially overlying the housing peripheral upper, side and end surfaces, thereby forming a substantially continuous skin contacting surface; and wherein said retainer member is formed of sheet metal material electrically conductive with said shaving blade.

61. A safety razor system as set forth in claim 55 which further includes a pair of elastomeric surfaces, one surface disposed on either side of said blade for tensioning the skin during shaving.

62. A safety razor system comprising:

an elongated housing having at least one shaving blade disposed thereon, each said at least one blade having a cutting edge extending lengthwise and upwardly from an upper surface of said housing, said housing upper surface having at least two skin-engaging surfaces disposed respectively before and behind said at least one blade;

a unitary annular retainer member having a pair of opposed longitudinal portions and a pair of opposed lateral portions joined thereto defining an open pocket therebetween, said annular retainer member being disposed substantially circumferentially about the periphery of said housing and contacting opposite ends of each said blade, said open pocket substantially unobstructing the at least two skin-engaging surfaces projecting upwardly from the housing; and a latch disposed on said retainer member adapted to attach to a mating portion of said housing member to restrain said retainer member against upward movement relative to said housing;

wherein said housing is substantially of rectangular shape in plan form having arcuate end portions;

said housing upper surface and said retainer member being arcuate in the transverse direction, said retainer member substantially overlying the housing peripheral upper, side and end surfaces, thereby forming a substantially continuous skin contacting surface with the at least two skin-engaging surfaces of the housing, and which further includes a pair of elastomeric surfaces, one surface disposed on either side of said blade for tensioning the skin during shaving, and wherein said elastomeric surfaces have a plurality of cup-shaped openings formed therein.

63. A safety razor system as set forth in claim 1, wherein the blades are biased upwardly against the retainer member for independent resilient movement.

64. A safety razor system as set forth in claim 56, wherein the blades are biased upwardly against the retainer member for independent resilient movement.

65. A safety razor system comprising:

an elongated housing having at least one shaving blade disposed thereon, each said blade biased upwardly for independent vertical resilient displacement and having a cutting edge extending lengthwise and upwardly from an upper surface of said housing;

a unitary retainer member disposed about the upper periphery of said housing and contacting opposite ends of each said shaving blade;

said housing comprising an upwardly extending lip forming an upwardly opening groove disposed about the periphery of said housing, and wherein said retainer member is disposed in said groove; and a latch disposed on said retainer member adapted to attach to a mating portion of said housing member to restrain said retainer member against upward movement relative to said housing, said latch depending downwardly from said retainer member and being permanently deformed to position said housing between said latch and said retainer member, whereby independent resilient movement of each said blade cutting edge in the upward direction is restricted by contact with said unitary retainer member.

66. A safety razor system as set forth in claim 65, wherein said at least one shaving blade comprises a plurality of blades in spaced relation.

67. A safety razor system, comprising:

an elongated housing having a guard, a cap, and at least one shaving blade located therebetween, each said at least one blade having a cutting edge extending lengthwise and upwardly from an upper surface of said housing, said guard being located before and said cap being located behind said at least one blade, said guard cooperating to determine an exposure of an adjacent said at least one blade;

a unitary retainer clip, formed of sheet metal material and being separate from said cap and said guard, disposed about the upper periphery of said housing in outwardly adjacent circumferentially surrounding relation about the cap and the guard of the housing and contacting opposite ends of each said shaving blade; and wherein said retainer clip comprises a latch adapted to attach to a mating portion of said housing member to restrain said retainer clip against upward movement relative to said housing, said latch depending downwardly from said retainer clip and being permanently deformed to position said housing between said latch and said retainer clip, whereby movement of each said blade cutting edge in the upward direction is restricted by contact with said unitary retainer clip.

68. A safety razor system as set forth in claim 67, wherein said at least one shaving blade comprises a plurality of blades in spaced relation.

69. A safety razor system as set forth in claim 68, wherein the blades are biased upwardly against the retainer clip for independent resilient movement.

* * * * *